US009345331B2

(12) United States Patent
Saval et al.

(10) Patent No.: US 9,345,331 B2
(45) Date of Patent: May 24, 2016

(54) SOFA STRETCHER RAIL

(71) Applicant: L & P PROPERTY MANAGEMENT COMPANY, South Gate, CA (US)

(72) Inventors: Paul B. Saval, Romulus, MI (US); Mark F. Hodges, Saltillo, MS (US)

(73) Assignee: L&P Property Management Company, South Gate, CA (US)

( * ) Notice: Subject to any disclaimer, the term of this patent is extended or adjusted under 35 U.S.C. 154(b) by 203 days.

(21) Appl. No.: 14/054,381

(22) Filed: Oct. 15, 2013

(65) Prior Publication Data

US 2015/0102651 A1 Apr. 16, 2015

(51) Int. Cl.

| | |
|---|---|
| ***A47C 7/02*** | (2006.01) |
| ***A47C 17/00*** | (2006.01) |
| ***A47C 19/02*** | (2006.01) |

(52) U.S. Cl.

CPC . *A47C 7/02* (2013.01); *A47C 17/00* (2013.01); *A47C 19/027* (2013.01)

(58) Field of Classification Search

CPC ..... A47C 17/00; A47C 19/027

USPC ..... 297/440.14, 440.16

See application file for complete search history.

(56) References Cited

U.S. PATENT DOCUMENTS

| | | | | |
|---|---|---|---|---|
| 5,894,614 | A * | 4/1999 | Stroud | A47B 91/028 5/200.1 |
| 6,415,465 | B1 * | 7/2002 | Harrow | A47C 19/027 5/184 |
| 6,625,827 | B1 * | 9/2003 | Polevoy | A47C 19/02 5/201 |
| 2007/0226902 | A1 * | 10/2007 | Lin | A47C 19/005 5/201 |
| 2009/0235451 | A1 * | 9/2009 | Gorkin | A47C 4/022 5/12.2 |
| 2010/0253127 | A1 * | 10/2010 | Haimoff | A47C 13/005 297/440.14 |
| 2012/0146382 | A1 * | 6/2012 | Griggs, Jr. | 297/440.1 |
| 2012/0217784 | A1 * | 8/2012 | Griggs, Jr. | 297/440.1 |

* cited by examiner

*Primary Examiner* — David R Dunn
*Assistant Examiner* — Tania Abraham
(74) *Attorney, Agent, or Firm* — Shook, Hardy & Bacon, L.L.P.

(57) ABSTRACT

A symmetrical sofa stretcher rail for compact assembly of a furniture item is provided. Embodiments of the invention include a symmetrical sofa stretcher rail with two ends that are mirror images of each other, which can thus be coupled to a seat box frame and installed inside a sofa frame with either end of the sofa stretcher rail coupling to either the front or rear of the sofa frame. In embodiments, the sofa stretcher rail may be pre-assembled as part of a seat box frame, and pivoted between a position parallel to the seat box frame and a position perpendicular to the seat box frame. Embodiments of the sofa stretcher rail include a curved central body, interior pivot tabs, fastening plates, and exterior mounting plates, having a plurality of attachment points for fastening the sofa stretcher rail to a sofa frame coupled to the seat box frame.

12 Claims, 7 Drawing Sheets

SOFA STRETCHER RAIL

CROSS-REFERENCE TO RELATED APPLICATIONS

Not applicable.

STATEMENT REGARDING FEDERALLY SPONSORED RESEARCH OR DEVELOPMENT

Not applicable.

TECHNICAL FIELD

Embodiments of the present invention generally relate to a sofa stretcher rail for assembling furniture items. More particularly, embodiments of the present invention relate to a symmetrical sofa stretcher rail for compact assembly of a furniture item, such as a seat box frame for installation in a sofa frame.

BACKGROUND OF THE INVENTION

In the manufacture of furniture items, such as a sofa or chair, various parts may be pre-assembled in a fabrication phase before being installed into the completed product. A seat box frame is one such pre-assembled component that is prepared for installation in the finished furniture item. In some instances, the seat box frame provides a support structure for a seating surface, and is installed in what would otherwise be an open space inside of the frame of a furniture item, such as a sofa. Seat box frames are typically assembled in a rectangular frame configuration, with wooden left, right, front, and rear sides, and webbing and/or wire springs that span across the top of the frame.

A variety of methods exist for stabilizing a seat box frame of a furniture item. Seat box frames may be assembled with stretcher rails between the front and rear sides of the seat box frame. In one example, wooden stretcher rails are used to hold the front and rear sides of the seat box frame apart, which helps resist the application of pressure to the seating surface supported by the webbing and/or springs. Additional stability of the seat box frame, by virtue of the stretcher rails, is needed because the front and rear sides of the wooden seat box frame are often not rigid enough to remain straight when tension is applied to the seating surface. However, traditional wooden stretcher rails are bulky and are time-consuming to assemble and install inside a seat box frame (prior to installing the seat box frame in the furniture item). Further, from a manufacturing perspective, storing pre-assembled seat box frames with wooden stretcher rails is a space-consuming practice that makes it difficult to store a sufficient supply of pre-assembled seat box frames in a staging area feeding a manufacturing line.

Accordingly, a need exists for a more compact sofa stretcher rail that provides enhanced support to the front and rear sides of the seat box frame, and can be easily installed in a finished furniture item.

BRIEF SUMMARY OF THE INVENTION

The present invention generally relates to a symmetrical sofa stretcher rail for compact assembly of a furniture item. Embodiments of the invention include a symmetrical sofa stretcher rail with two ends that are mirror images of each other, which can thus be coupled to a seat box frame and installed inside a sofa frame with either end of the sofa stretcher rail coupling to either the front or rear of the sofa frame. In embodiments, the sofa stretcher rail may be pre-assembled as part of a seat box frame, and pivoted into a position parallel to the seat box frame for more compact storage relative to a pre-assembled seat box frame having wooden stretcher rails.

In one illustrative embodiment of the invention, a symmetrical sofa stretcher rail for seat box fabrication is provided. The sofa stretcher rail includes a first end comprising: (1) a first exterior mounting plate; (2) a first interior pivot tab; and (3) a first fastening plate between the first exterior mounting plate and the first interior pivot tab. Additionally, the sofa stretcher rail includes a second end comprising: (1) a second exterior mounting plate; (2) a second interior pivot tab; and (3) a second fastening plate between the second exterior mounting plate and the second interior pivot tab. Further, the sofa stretcher rail includes a curved body between the first end and the second end.

In another illustrative aspect, a metal sofa stretcher rail includes: a first end comprising: (1) a first exterior mounting plate; (2) a first fastening plate perpendicular to the first exterior mounting plate; and (3) a first interior pivot tab perpendicular to the first fastening plate. The metal sofa stretcher rail further includes a second end comprising: (1) a second exterior mounting plate; (2) a second fastening plate perpendicular to the second exterior mounting plate; and (3) a second interior pivot tab perpendicular to the second fastening plate. The metal sofa stretcher rail also includes a central body between the first end and second end, wherein the central body, the first fastening plate, and the second fastening plate are arranged in a single plane, and further wherein the first exterior mounting plate, the first interior pivot tab, the second exterior mounting plate, and the second interior pivot tab are arranged in parallel planes, wherein each of the parallel planes are perpendicular to the single plane.

According to a third illustrative aspect, embodiments of the invention are directed to a sofa stretcher rail including a first end and a second end. The first end includes (1) a first exterior mounting plate configured to couple to a front sofa rail of a sofa frame; (2) a first fastening plate configured to couple to a rear back post of the sofa frame; and (3) a first interior pivot tab configured to couple to a seat box frame. The second end includes (1) a second exterior mounting plate configured to couple to the front sofa rail of the sofa frame; (2) a second fastening plate configured to couple to the rear back post of the sofa frame; and (3) a second interior pivot tab configured to couple to the seat box frame. Additionally, the sofa stretcher rail includes a curved body between the first end and the second end, wherein when the first interior pivot tab and the second interior pivot tab are coupled to the seat box frame, at least a portion of the sofa stretcher rail is pivotable between a first position parallel to the seat box frame and a second position perpendicular to the seat box frame.

Additional objects, advantages, and novel features of the invention will be set forth in part in the description that follows, and in part will become apparent to those skilled in the art upon examination of the following, or may be learned by practice of the invention.

BRIEF DESCRIPTION OF SEVERAL VIEWS OF THE DRAWINGS

The present invention is described in detail below with reference to the attached drawing figures, wherein.

DETAILED DESCRIPTION OF THE INVENTION

The present invention generally relates to a symmetrical sofa stretcher rail for compact assembly of a furniture item. Embodiments of the invention include a symmetrical sofa stretcher rail with two ends that are mirror images of each other, which can thus be coupled to a seat box frame and installed inside a sofa frame with either end of the sofa stretcher rail coupling to either the front or rear of the sofa frame. The stretcher rails may be coupled to a seat box frame prior to installation of the seat box frame inside of a sofa frame. As such, in embodiments, sofa stretcher rails of a pre-assembled seat box frame may be pivoted into a collapsed position relative to the seat box frame for compact storage of the pre-assembled seat box frame. Once the body of the seat box frame is positioned inside the sofa frame, the sofa stretcher rails may be pivoted into an extended position relative to the seat box frame, and the seat box frame may then be secured to the sofa frame using one or more attachment points on the sofa stretcher rails. In some embodiments, because the sofa stretcher rail is symmetrical, it can be coupled to a particular portion of the seat box frame, in a particular position and/or orientation, based on the desired direction of pivoting between the collapsed and extended positions during installation inside a sofa frame.

Figure 1:
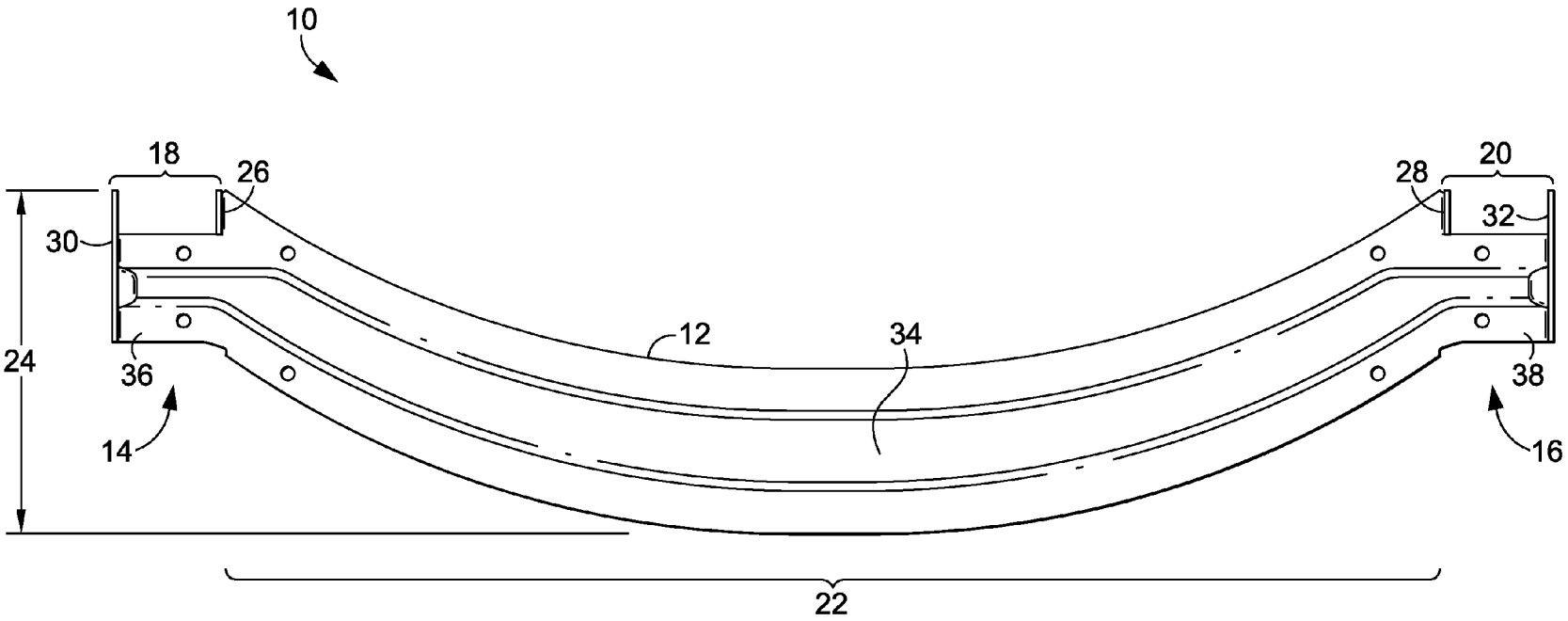
FIG. 1 is a side view of a sofa stretcher rail, in accordance with an embodiment of the invention.

An embodiment of the sofa stretcher rail is seen in the side view of FIG. 1. In the embodiment of FIG. 1, the sofa stretcher rail 10 generally includes a rail body 12 having a first end 14, a second end 16, with corresponding attachment portions 18, and 20. The rail body 12 of the exemplary sofa stretcher rail 10 includes a curved and/or central body 22 positioned generally between the attachment portions 18 and 20. As shown in the example of FIG. 1, the curved portion of the central body 22 provides an overall depth 24 of the rail body 12. Further, as discussed in more detail below, the sofa stretcher rail 10 includes a first interior pivot tab 26, a second interior pivot tab 28, a first exterior mounting plate 30, and a second exterior mounting plate 32. In some embodiments, the first interior pivot tab 26 and the second interior pivot tab 28 couple to a seat box frame of a furniture item.

With continued reference to FIG. 1, the rail body 12 of the sofa stretcher rail 10 includes a stiffening rib 34 along at least a portion of the rail body 12. In embodiments, the stiffening rib 34 is molded into at least a portion of a metal rail body 12 to provide additional compressive strength to the overall structure during use. In one embodiment, stiffening rib 34 prevents buckling, bending, and/or twisting of the curved and/or central body 22, which would occur if the metal rail body 12 was not reinforced by the stiffening rib 34. For example, the stiffening rib 34 may provide additional compressive strength to a sofa stretcher rail 10 installed in a seat box frame topped with seat webbing and/or springs, such that the stiffening rib 34 provides additional compressive strength to the sofa stretcher rail 10 to resist forces applied to the seat webbing and/or springs.

Figure 3:
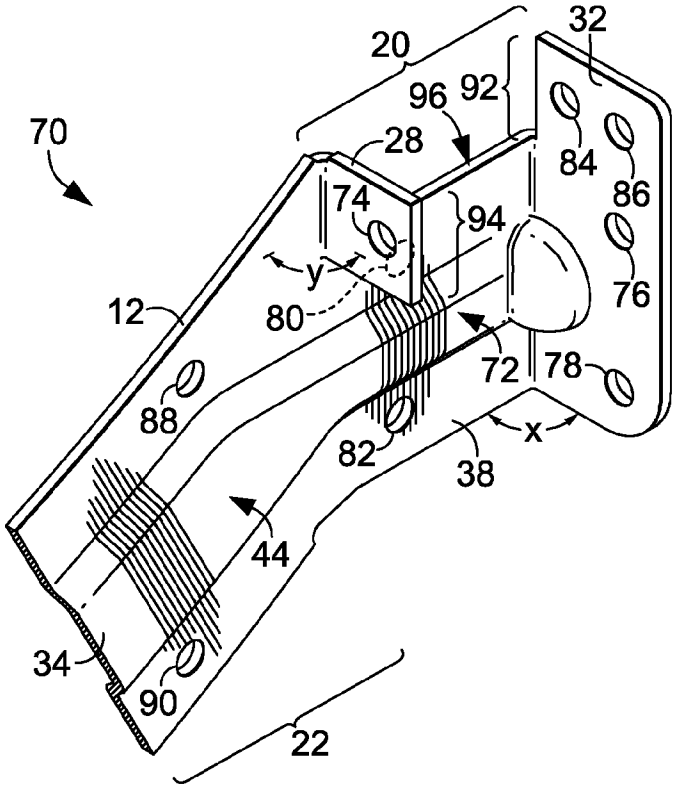
FIG. 3 is a perspective, side view of a second end of the sofa stretcher rail of FIG. 1, in accordance with an embodiment of the invention.
Figure 2:
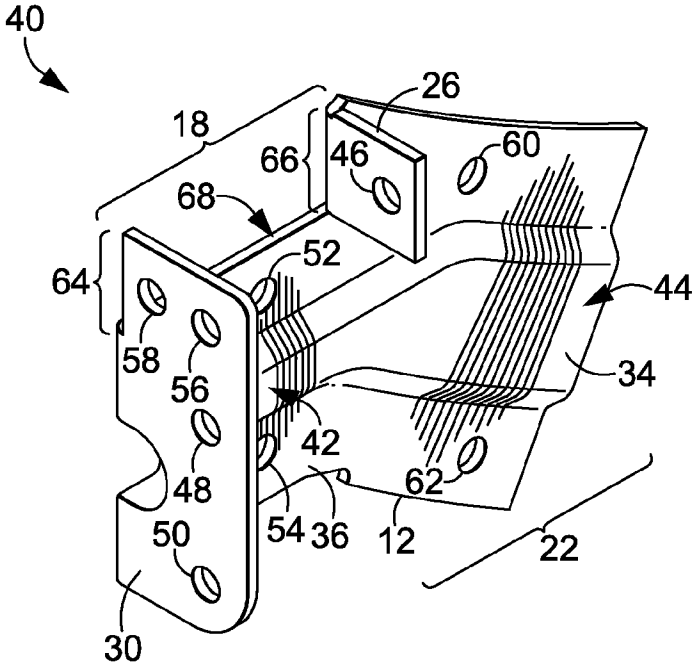
FIG. 2 is a perspective, side view of a first end of the sofa stretcher rail of FIG. 1, in accordance with an embodiment of the invention.

In embodiments, the stiffening rib 34 is incorporated into one or more of the central body 22, the first fastening plate 36, the second fastening plate 38, the first exterior mounting plate 30, and the second exterior mounting plate 32. As such, in one embodiment, the stiffening rib 34 provides additional stiffness to a metal rail body 12 as incorporated into the central body 22, the first fastening plate 36, and the second fastening plate 38. In particular, in the examples of FIGS. 2-3, the portion 44 of the stiffening rib 34 on the curved body 22 may extend onto the adjoining fastening plates, as demonstrated by the portion of the stiffening rib 42 on the first fastening plate 36, and the portion of the stiffening rib 72 on the second fastening plate 38. Further, as shown in FIGS. 2-3, the stiffening rib 34 may extend from the first and second fastening plates 36 and 38, onto at least a portion of the first and second exterior mounting plates 30 and 32. As such, the stiffening rib 34 spans the 90-degree angle X between the first and second fastening plates 36 and 38, and the adjoining first and second exterior mounting plates 30 and 32, respectively. In embodiments, the stiffening rib provides additional strength to the rail body 12 where the first and second fastening plates 36 and 38 meet the first and second exterior mounting plates 30 and 32 (i.e., at the 90-degree angle X formed between the adjoining portions of the sofa stretcher rail 10).

With reference now to FIG. 2, a perspective, side view 40 of the first end 14 of the sofa stretcher rail 10 is depicted according to an embodiment of the invention. In embodiments, both ends of the sofa stretcher rail 10 are configured to couple to either the front or rear sides of a furniture item, such as the front side or rear side of a sofa frame. As such, a seat box frame coupled to at least one sofa stretcher rail 10 may be installed in a first direction inside a sofa frame (e.g., with the first end 14 adjacent the rear side of the sofa frame) or in a second direction inside a sofa frame (e.g., with the first end 14 adjacent the front side of the sofa frame).

In one embodiment of the invention, the first end 14 may be preliminarily attached to a seat box frame using the first interior pivot tab 26. As used herein, the preliminary attachment of a sofa stretcher rail 10 to a seat box frame refers to the coupling of at least one sofa stretcher rail to a seat box frame prior to installing the pre-assembled seat box frame inside a furniture item, such as a sofa frame. As shown in the example of FIG. 2, the first interior pivot tab 26 on the first end 14 of the rail body 12 includes an attachment point 46 that can be used to couple the first end 14 to a seat box frame for installation inside a furniture item. In one embodiment, attachment point 46 is an aperture in the first interior pivot tab 26 through which a fastener (e.g., a screw) can be secured. Further, as shown in FIGS. 2-3, one embodiment of the sofa stretcher rail 10 includes the first interior pivot tab 26 and second interior pivot tab 28 positioned at 90-degree angles Y relative to the plane of the rail body 12. As such, in some embodiments, first exterior mounting plate 30, first interior pivot tab 26, second interior pivot tab 28, and second exterior mounting plate 32 are arranged in parallel planes. Further, the parallel planes of the first exterior mounting plate 30, first interior pivot tab 26, second interior pivot tab 28, and second exterior mounting plate 32 are perpendicular to the plane of the central body 22, first fastening plate 36, and second fastening plate 38.

In another embodiment, attachment point 46 includes a portion of the first interior pivot tab 26 where the metal rail body 12 is lanced to create a protrusion on the surface of the first interior pivot tab 26. For example, a triangular piercing punch may forcefully mark the surface of the first interior pivot tab 26 to provide an attachment point 46 that attaches and/or "grabs" the wood surface of a seat box frame. In that example, during assembly of the seat box frame, a sofa stretcher rail 10 may be coupled to the seat box frame by tapping the first end 14 (and second end 16) of the sofa stretcher rail into the seat box frame to couple the lanced-surface attachment point 46 to the front and rear of the seat box frame. In embodiments, the attachment point 46 may be used for temporary or permanent attachment of the sofa stretcher rail 10 to a portion of a seat box frame.

With continued reference to FIG. 2, the first end 14 of the sofa stretcher rail 10 includes a first attachment point 48 and a second attachment point 50 on the first exterior mounting plate 30. In one embodiment, first and second attachment points 48 and 50 are apertures in the first exterior mounting plate 30 through which a fastener (e.g., a screw) can be secured. During installation of a sofa stretcher rail 10 (coupled to a seat box frame) inside a sofa frame, one or both of the first and second attachment points 48 and 50 may be used to couple the first exterior mounting plate 30 to a front side of the sofa frame. For example, a fastener inserted through the front side of a sofa frame may be secured inside the aperture of the first attachment point 48. As such, in one embodiment, the first end 14 of the sofa stretcher rail 10 is coupled to the front sofa rail of a sofa frame using one or more fasteners coupled to at least one of the first attachment point 48 and the second attachment point 50.

In another embodiment, the first end 14 of a sofa stretcher rail 10 is coupled to the rear back post of a sofa frame, using fasteners coupled to at least one of the first attachment point 52 and the second attachment point 54 on the first fastening plate 36. As shown in FIG. 2, the first and second attachment points 52 and 54 are positioned on the first fastening plate 36 for attachment to a rear side of a furniture item, such as a rear back post of a sofa frame. Accordingly, the first end 14 of the sofa stretcher rail 10 is configured to couple to either the front side (front sofa rail of a sofa frame) or back side (rear back post of a sofa frame) using at least one of the first attachment point 48, second attachment point 50, first attachment point 52, and second attachment point 54. In one embodiment, the sofa stretcher rail is coupled to a seat box frame (during pre-assembly) using the first attachment point 46, and is further secured to a sofa frame (during installation) using at least one attachment point on the corresponding exterior mounting plate or fastening plate.

In one embodiment of the invention, additional attachment points 56 and 58 on the first exterior mounting plate 30, and attachment points 60 and 62 on the central body 22, are not used when securing the sofa stretcher rail 10 to a seat box frame (i.e., preliminary attachment) or to a sofa frame (i.e., installation). As will be understood, any number of attachment points may be included on the rail body 12 of the sofa stretcher rail 10 for pivotable coupling to a seat box frame, or stationary attachment to a sofa frame. In one embodiment, the attachment point 46 of the first interior pivot tab 26 is used to pivotably attach the sofa stretcher rail 10 with respect to a seat box frame, while either the first exterior mounting plate 30 (using first and/or second attachment points 48 and 50) and first fastening plate 36 (using first and/or second attachment points 52 and 54) are used to secure the sofa stretcher rail 10 in a stationary position with respect to a sofa frame.

As shown in FIG. 2, first exterior mounting plate 30 extends a distance 64 above the top edge 68 of the first fastening plate 36, while the first interior pivot tab 26 extends a distance 66 above the top edge 68 of the first fastening plate 36. Accordingly, the first end 14 of a sofa stretcher rail 10 may be coupled to a seat box frame at attachment point 46 on first interior pivot tab 26 such that the seat box frame is nested between portions of the first exterior mounting plate 30 and the first interior pivot tab 26, and above the top edge 68 of the first fastening plate 36. In embodiments, the sofa stretcher rail 10 is pivotable about the attachment point 46, and between a horizontal position parallel to the plane of a seat box frame and a vertical position perpendicular to a seat box frame, based at least in part on the configuration of the attachment portion 18 of first end 14 (i.e., the distances 64 and 66 above top edge 68).

Turning now to the perspective, side view 70 of FIG. 3, the mirror-image second end 16 of a sofa stretcher rail 10 is depicted according to an embodiment of the invention. Similar to the first end 14 described with reference to FIG. 2, the second end 16 includes an attachment point 74 on second interior pivot tab 28 for pivotable coupling of the second end 16 to a seat box frame. As will be understood from the parallel description of attachment point 46 on first interior pivot tab 26, in embodiments of the invention, the second end 16 may be preliminarily attached to a seat box frame using the attachment point 74 on second interior pivot tab 28. In embodiments, the second interior pivot tab 28 on the second end 16 of the rail body 12 includes an attachment point 74 that can be used to couple the second end 16 to a seat box frame for installation inside a furniture item. In one embodiment, attachment point 74 is an aperture in the second interior pivot tab 28 through which a fastener (e.g., a screw) can be secured.

In another embodiment, attachment point 74 includes a portion of the second interior pivot tab 28 where the metal rail body 12 is lanced to create a protrusion on the surface of the second interior pivot tab 28, providing an attachment point 74 that attaches and/or "grabs" the wood surface of a seat box frame. In that example, during assembly of the seat box frame, a sofa stretcher rail 10 may be coupled to the seat box frame by tapping the second end 16 (and first end 14) of the sofa stretcher rail into the seat box frame to couple the lanced-surface attachment point 74 to the front and rear of the seat box frame. In embodiments, the attachment point 74 may be used for temporary or permanent attachment of the sofa stretcher rail 10 to a portion of a seat box frame.

As such, a seat box frame may be preassembled with a first end 14 of a sofa stretcher rail 10 coupled to a front or rear side of the seat box frame, and the second end 16 of the sofa stretcher rail 10 coupled to the opposing side of the seat box frame. Having coupled the sofa stretcher rail 10 to the seat box frame at the first and second interior pivot tabs 26 and 28 (using attachment points 46 and 74, respectively) the sofa stretcher rail 10 is pivotable between a first position parallel to the horizontal plane of the seat box frame, and a second position perpendicular to the seat box frame.

With continued reference to FIG. 3, the second end 16 of the sofa stretcher rail 10 includes a first attachment point 76 and a second attachment point 78 on the second exterior mounting plate 32. In one embodiment, first and second attachment points 76 and 78 are apertures in the second exterior mounting plate 32 through which a fastener (e.g., a screw) can be secured. During installation of a sofa stretcher rail 10 (coupled to a seat box frame) inside a sofa frame, one or both of the first and second attachment points 76 and 78 may be used to couple the second exterior mounting plate 32 to a front side of the sofa frame. For example, a fastener inserted through the front side of a sofa frame may be secured inside the aperture of the first attachment point 76. As such, in one embodiment, the second end 16 of the sofa stretcher rail 10 is coupled to the front sofa rail of a sofa frame using one or more fasteners coupled to at least one of the first attachment point 76 and the second attachment point 78.

In another embodiment, the second end 16 of a sofa stretcher rail 10 is coupled to the rear back post of a sofa frame, using fasteners coupled to at least one of the first attachment point 80 and the second attachment point 82 on the second fastening plate 38. As shown in FIG. 3, the first and second attachment points 80 and 82 are positioned on the second fastening plate 38 for attachment to a rear side of a furniture item, such as a rear back post of a sofa frame. Accordingly, the second end 16 of the sofa stretcher rail 10 is configured to couple to either the front side (front sofa rail of a sofa frame) or back side (rear back post of a sofa frame) using at least one of the first attachment point 76, second attachment point 78, first attachment point 80, and second attachment point 82. In one embodiment, the sofa stretcher rail is coupled to a seat box frame (during pre-assembly) using the first attachment point 74, and is further secured to a sofa frame (during installation) using at least one attachment point on the corresponding exterior mounting plate or fastening plate.

In one embodiment of the invention, additional attachment points 84 and 86 on the second exterior mounting plate 32, and attachment points 88 and 90 on the central body 22, are not used when securing the sofa stretcher rail 10 to a seat box frame (i.e., preliminary attachment) or to a sofa frame (i.e., installation). As will be understood, any number of attachment points may be included on the rail body 12 of the sofa stretcher rail 10 for pivotable coupling to a seat box frame and/or stationary attachment to a sofa frame. In one embodiment, the attachment point 74 of the second interior pivot tab 28 is used to pivotably attach the sofa stretcher rail 10 with respect to a seat box frame, while either the second exterior mounting plate 32 (using first and/or second attachment points 76 and 78) and second fastening plate 38 (using first and/or second attachment points 80 and 82) are used to secure the sofa stretcher rail 10 in a stationary position with respect to a sofa frame.

As shown in FIG. 3, second exterior mounting plate 32 extends a distance 92 above the top edge 96 of the second fastening plate 38, while the second interior pivot tab 28 extends a distance 94 above the top edge 96 of the second fastening plate 38. Accordingly, the second end 16 of a sofa stretcher rail 10 may be coupled to a seat box frame at attachment point 74 on second interior pivot tab 28 such that the seat box frame is nested between portions of the second exterior mounting plate 32 and the second interior pivot tab 28, and above the top edge 96 of the second fastening plate 38. In embodiments, the sofa stretcher rail 10 is pivotable about the attachment point 74, and between a horizontal position parallel to the plane of a seat box frame and a vertical position perpendicular to a seat box frame, based at least in part on the configuration of the attachment portion 20 of second end 16 (i.e., the distances 92 and 94 above top edge 96).

Figure 4A:
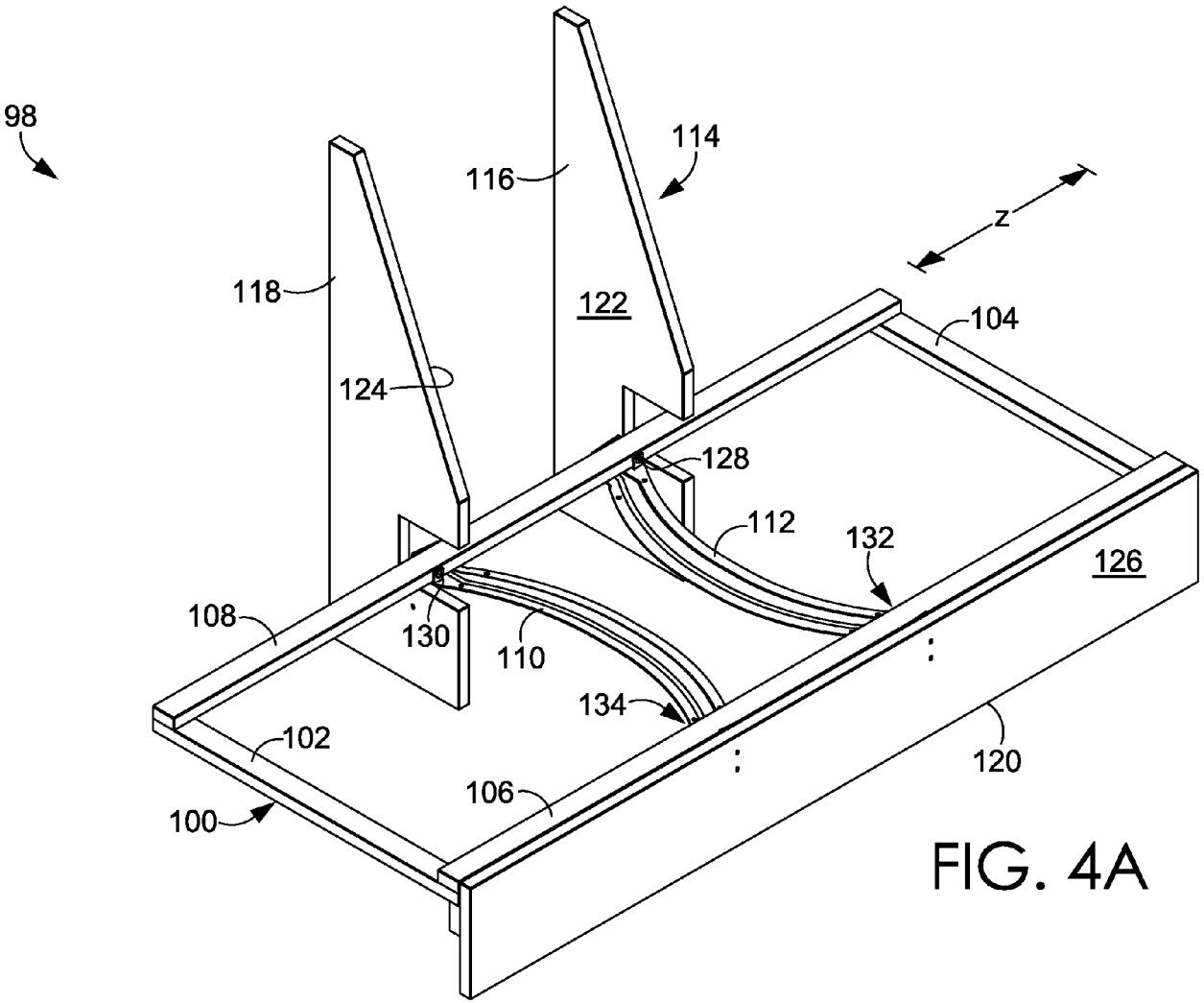
FIG. 4A is a perspective view of a pair of sofa stretcher rails coupled to a seat box frame, installed inside a portion of a sofa frame, in accordance with an embodiment of the invention.

Referring next to FIG. 4A, a perspective view 98 of a pair of sofa stretcher rails coupled to a seat box frame 100 is depicted according to an embodiment of the invention. The seat box frame 100 includes a left side 102, a right side 104, a front side 106, and a rear side 108. The first sofa stretcher rail 110 and the second sofa stretcher rail 112 are coupled to the front side 106 and rear side 108 of the seat box frame 100 with fasteners 128, 130, 132, and 134. In particular, the first end 14 of the first sofa stretcher rail 110 is coupled to the front side 106 of the seat box frame 100, while the second end 16 of the first sofa stretcher rail 110 is coupled to the rear side 108 of the seat box frame 100. Additionally, the first end 14 of the second sofa stretcher rail 112 is coupled to the rear side 108 of the seat box frame 100, while the second end 16 of the second sofa stretcher rail 112 is coupled to the front side 106 of the seat box frame 100.

As shown in the embodiment of FIG. 4A, when coupled to the seat box frame 100, the first and second sofa stretcher rails 110 and 112 may be rotated into positions such that the rail bodies 12 of each sofa stretcher rail are positioned parallel to the plane "Z" of the seat box frame 100. In other words, based on rotation about the interior pivot tabs of each sofa stretcher rail, coupled to the seat box frame 100 by fasteners 128, 130, 132, and 134, one or both of the first and second sofa stretcher rails may be rotated into a position parallel to the plane "Z."

Figure 4B:
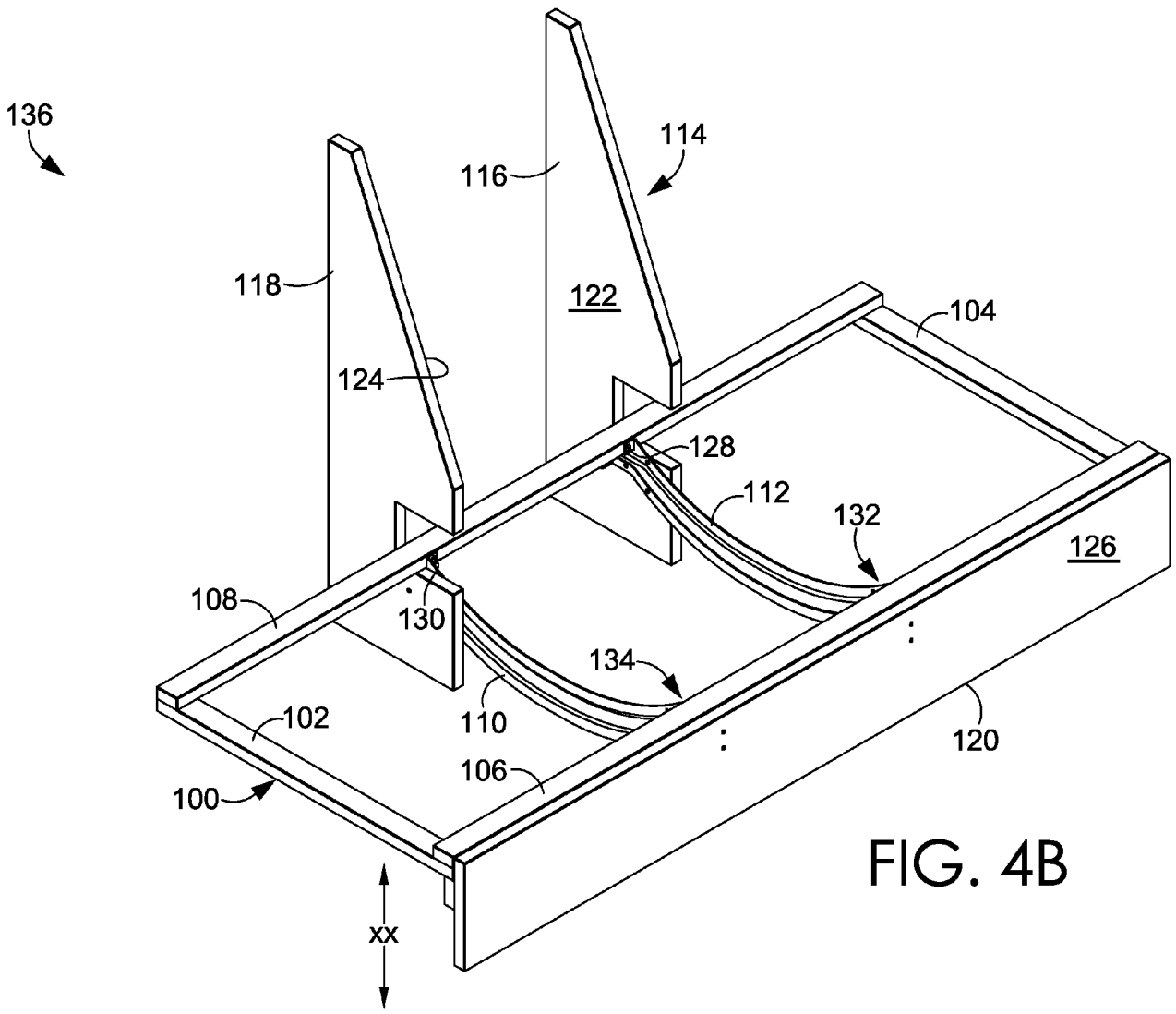
FIG. 4B is a perspective view of the sofa stretcher rails of FIG. 4A, pivoted into a vertical position with respect to the sofa frame, in accordance with an embodiment of the invention.

With reference to FIG. 4B, a perspective view 136 of a pair of sofa stretcher rails coupled to a seat box frame 100 is depicted according to an embodiment of the invention. With contrast to FIG. 4A, the first and second sofa stretcher rails 110 and 112 have been rotated in FIG. 4B into a plane "XX" perpendicular to the plane "Z" of the seat box frame 100. In one embodiment, based on coupling of the interior pivot tabs of each sofa stretcher rail to the seat box frame by fasteners 128, 130, 132, and 134, the first and second sofa stretcher rails 110 and 112 may be rotated between a position parallel to the seat box frame 100 (plane "Z") and a position perpendicular to the seat box frame 100 (plane "XX"). In one embodiment, a sofa stretcher rail (such as first and/or second sofa stretcher rails 110 and 112) may be pre-attached to a seat box frame 100 during a fabrication stage, and positioned parallel to the "Z" plane during storage of the seat box frame 100 for later installation in to the sofa frame 114. Accordingly, upon installation of the seat box frame 100 inside a sofa frame 114, the pre-attached sofa stretcher rail(s) may be pivoted from a position parallel to the "Z" plane into a position perpendicular to the "Z" plane (i.e., a position in the "XX" plane.)

Figure 4C:
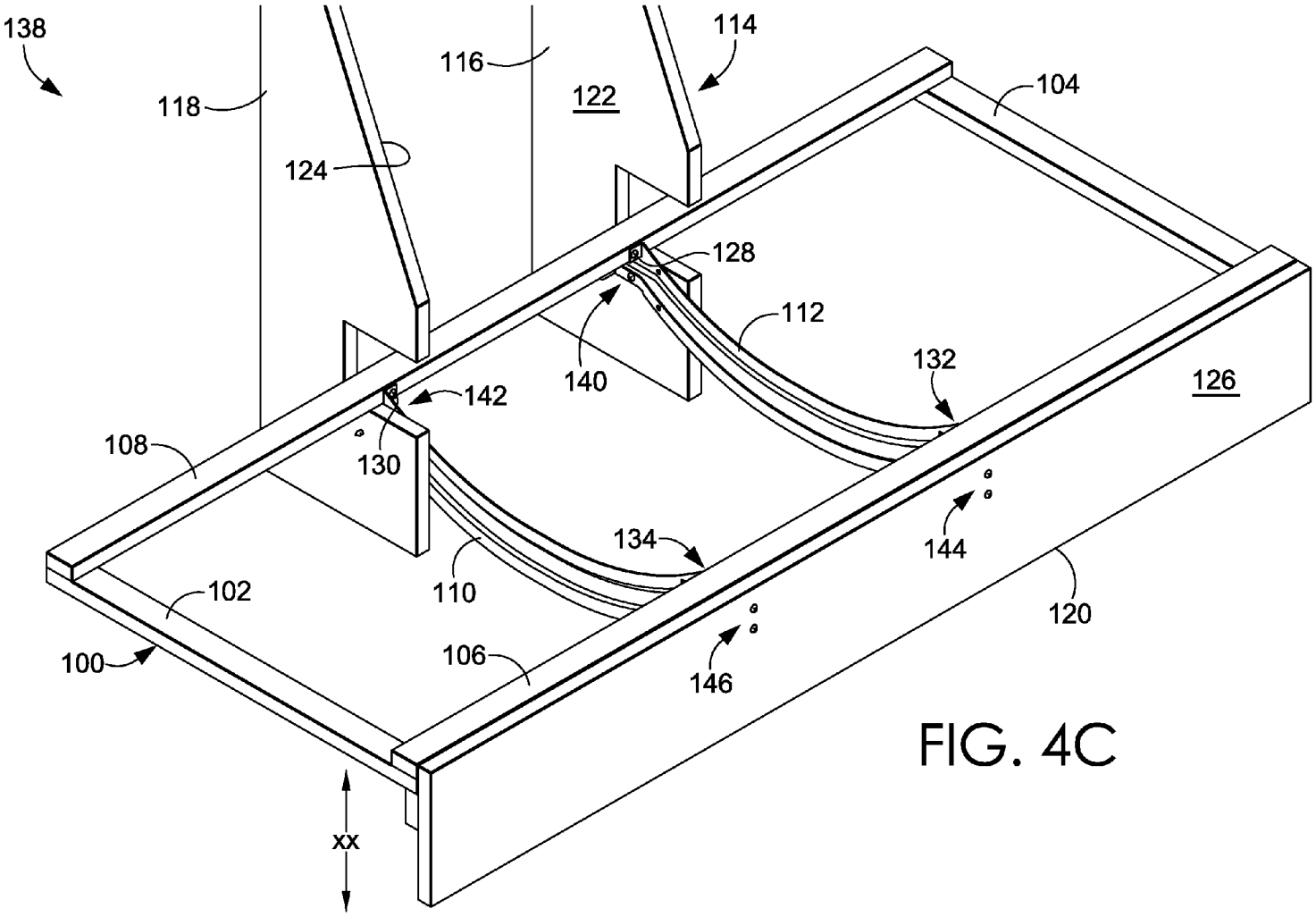
FIG. 4C is an enlarged, perspective view of the sofa stretcher rails of FIG. 4B, with fasteners securing the sofa stretcher rails to the sofa frame, in accordance with an embodiment of the invention.

Having rotated the first and second sofa stretcher rails 110 and 112 into the "XX" plane, as shown in the enlarged, fastened view 138 of FIG. 4C, each end of the first and second sofa stretcher rail may be secured to prevent further rotation. Accordingly, in the exemplary embodiment of FIG. 4C, the first sofa stretcher rail 110 is coupled to the front sofa rail 120 at fastening area 146, and to the second rear back post 118 at fastening area 142. Further, the second sofa stretcher rail 112 is coupled to the front sofa rail 120 at fastening area 144, and to the first rear back post 116 at fastening area 140. In one embodiment, when the first sofa stretcher rail 110 is rotated into a position perpendicular to the plane Z of the seat box frame 100, at least one fastener, such as a screw or other fastening device, is used to couple the first end 14 of the first sofa stretcher rail 110 to the front sofa rail 120, while at least one fastener is used to couple the second end 16 of the first sofa stretcher rail 110 to the second rear back post 118.

Figure 5B:
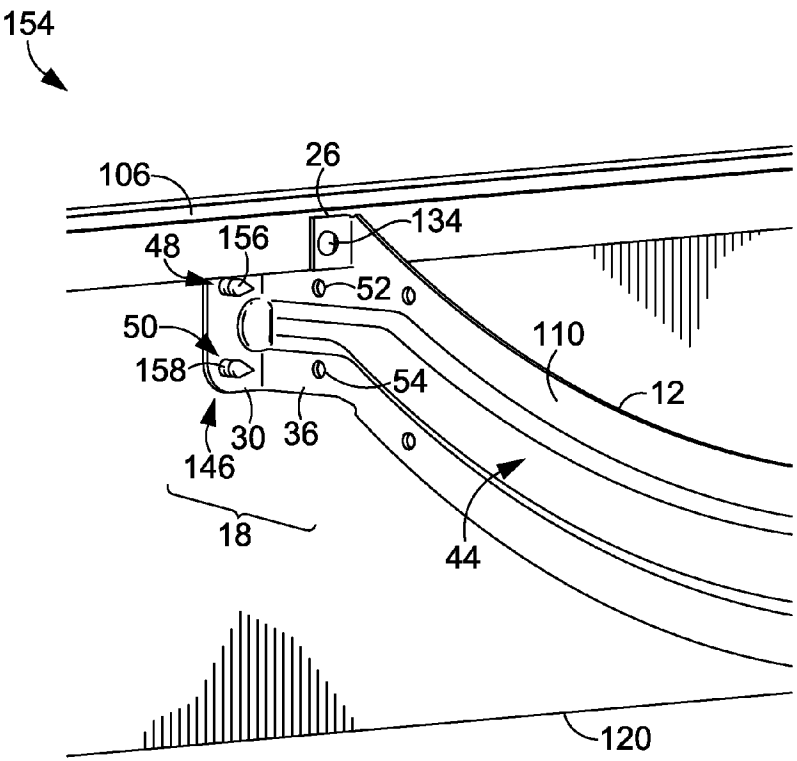
FIG. 5B is an enlarged, perspective view of the first end of a sofa stretcher rail installed in a sofa frame; in accordance with an embodiment of the invention.
Figure 5A:
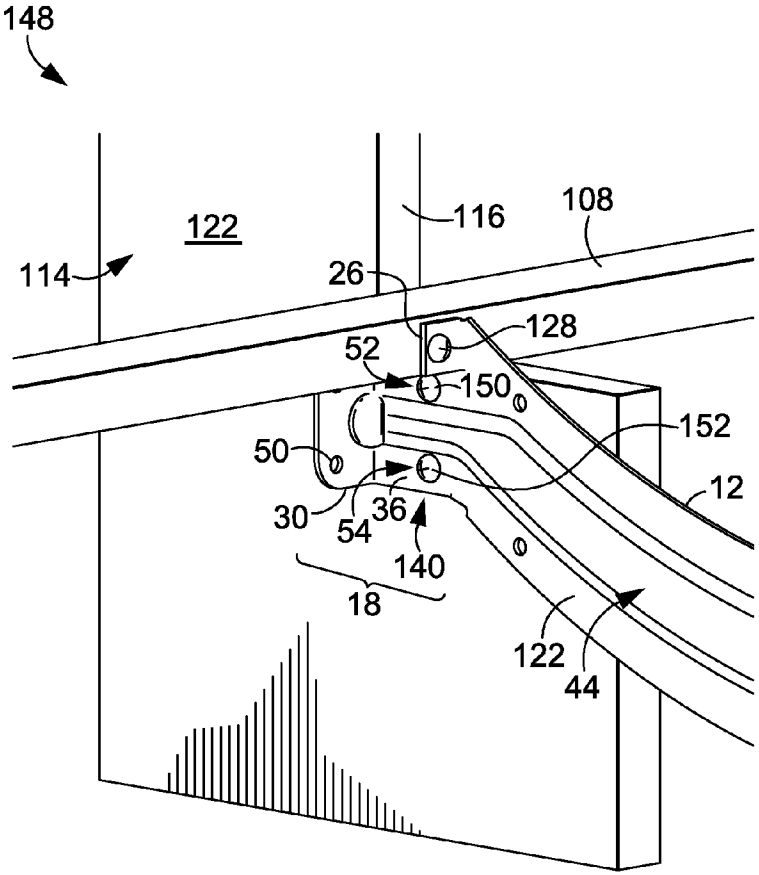
FIG. 5A is an enlarged, perspective view of the first end of a sofa stretcher rail installed in a sofa frame, in accordance with an embodiment of the invention.

Turning now to FIG. 5A, an enlarged view 148 of the fastening area 140 includes a fastener 150 coupling the first fastening plate 36 to the interior surface 122 of first rear back post 116 via first attachment point 52. Additionally, as shown in the example of FIG. 5A, fastener 152 couples the first fastening plate 36 to the interior surface 122 of the first rear back post 116 via second attachment point 54. In embodiments, a single fastener (fastener 150 or fastener 152) is used to secure the sofa stretcher rail to a rear back post of a sofa frame 114, at either the first or second attachment points 52 and 54. In a further embodiment, both attachment points 52 and 52 are secured with fasteners.

Turning now to the enlarged view 154 of fastening area 146 in FIG. 5B, a fastener 156 is depicted coupling the first exterior mounting plate 30 to the front sofa rail 120 at first attachment point 48. Additionally, fastener 158 couples the first exterior mounting plate 30 to the front sofa rail 120 at second attachment point 50. As discussed with reference to FIG. 5A, one or both of the first or second attachment points 48 and 50 may be used to couple the first exterior mounting plate 30 to a front sofa rail of a sofa frame 114. In particular, a fastener (156 and/or 158) may be secured through the front surface 126 (depicted in FIGS. 4A-C) of the front sofa rail 120 and into one or both attachment points 48 and 50.

Figure 6:
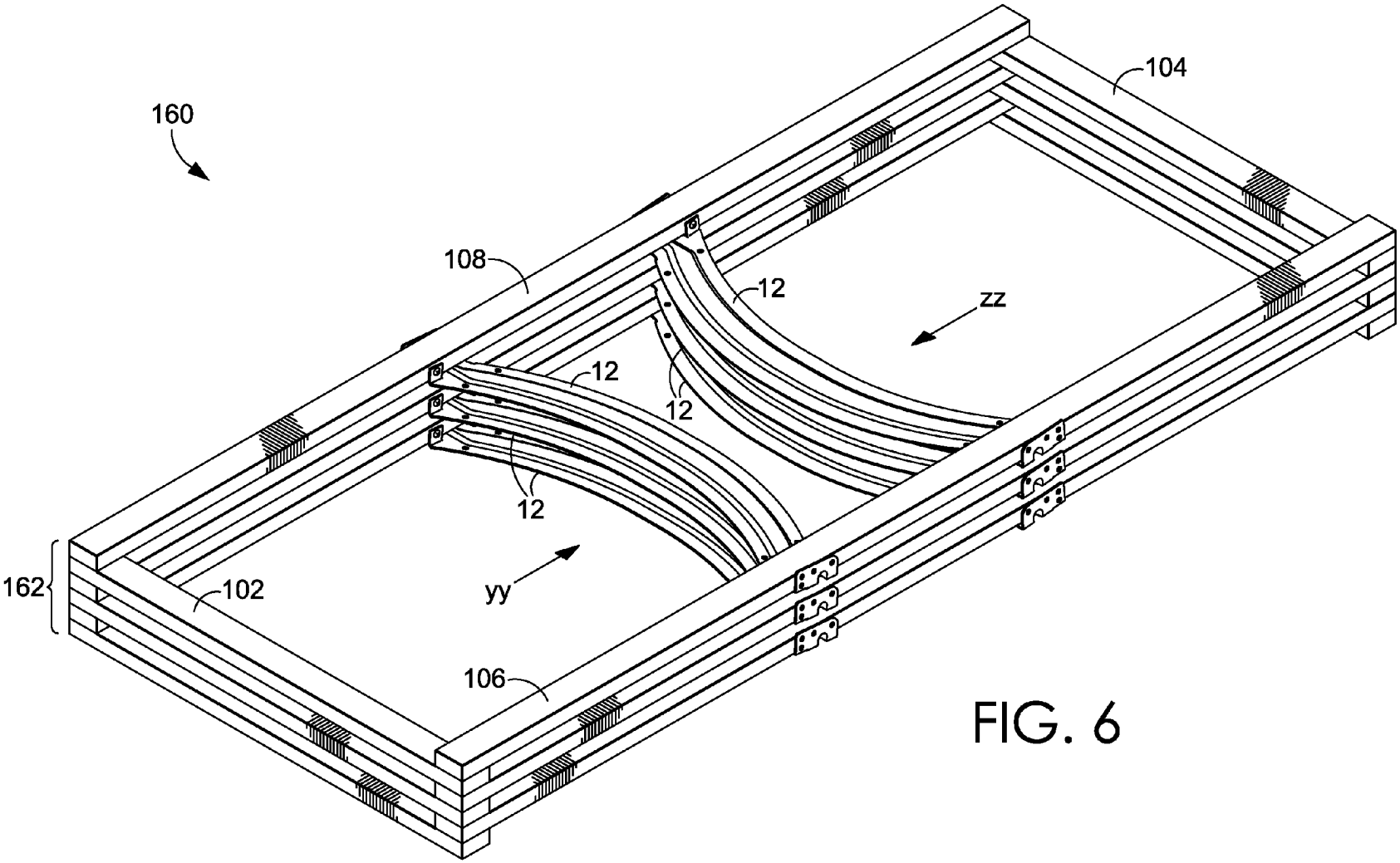
FIG. 6 is a perspective view of multiple sofa stretcher rails coupled to multiple seat box frames in a stacked configuration, in accordance with an embodiment of the invention.

Referring finally to FIG. 6, a stacked view 160 of a plurality of stacked seat box frames 162 is provided according to an embodiment of the invention. In one embodiment, based on the orientation and/or coupling of one or more sofa stretcher rails, a pre-assembled seat box frame of the plurality of seat box frames 162 may be stacked against (i.e., above or below) similarly situated seat box frames. In other words, because a pre-attached sofa stretcher rail may be rotated into a position parallel to the plane of the seat box frame, multiple seat box frames may be stacked adjacent each other. In one embodiment, multiple pre-attached seat box frames having at least one sofa stretcher rail may be stacked together during a fabrication stage, for later coupling of an individual seat box frame from the plurality, into a sofa frame during installment.

From the foregoing, it will be seen that this invention is one well adapted to attain all the ends and objects hereinabove set forth together with other advantages, which are obvious and inherent to the structure. It will be understood that certain features and subcombinations are of utility and may be employed without reference to other features and subcombinations. This is contemplated by and is within the scope of the claims. Since many possible embodiments may be made of the invention without departing from the scope thereof, it is to be understood that all matter herein set forth or shown in the accompanying drawings is to be interpreted as illustrative and not in a limiting sense.

The invention claimed is:

1. A symmetrical sofa stretcher rail for seat box fabrication, the sofa stretcher rail comprising:

a first end comprising:

(1) a first exterior mounting plate;

(2) a first interior pivot tab; and (3) a first fastening plate between the first exterior mounting plate and the first interior pivot tab;

a second end comprising:

(1) a second exterior mounting plate;

(2) a second interior pivot tab; and (3) a second fastening plate between the second exterior mounting plate and the second interior pivot tab; and a curved body between the first end and the second end, wherein the first interior pivot tab and the second interior pivot tab are configured to couple the sofa stretcher rail to a seat box frame of a furniture item, wherein the seat box frame comprises a front side and a rear side, wherein when the sofa stretcher rail is in a first position relative to the seat box frame, the sofa stretcher rail is arranged in a plane parallel to a plane of the seat box frame, wherein when the sofa stretcher rail is in a second position relative to the seat box frame, the sofa stretcher rail is arranged in a plane perpendicular to the plane of the seat box frame, wherein the sofa stretcher rail is configured to pivot between the first position and the second position based on pivoting about the first interior pivot tab and the second interior pivot tab, wherein the sofa stretcher rail is configured to couple the seat box frame to a sofa frame, said sofa frame comprising a rear back post and a front sofa rail, said rear back post adjacent the rear side of the seat box frame and said front sofa rail adjacent the front side of the seat box frame, wherein when the sofa stretcher rail is configured for assembly in a first orientation and the sofa stretcher rail is in the second position relative to the seat box frame, the first exterior mounting plate is configured to couple to the front sofa rail, and the second fastening plate is configured to couple to the rear back post, wherein when the sofa stretcher rail is configured for assembly in a second orientation and the sofa stretcher rail is in the second position relative to the seat box frame, the second exterior mounting plate is configured to couple to the front sofa rail and the first fastening plate is configured to couple to the rear back post.

2. The sofa stretcher rail of claim 1, wherein the first end is a minor image of the second end.

3. A metal sofa stretcher rail comprising:

a first end comprising:

(1) a first exterior mounting plate;

(2) a first fastening plate perpendicular to the first exterior mounting plate; and (3) a first interior pivot tab perpendicular to the first fastening plate;

a second end comprising:

(1) a second exterior mounting plate;

(2) a second fastening plate perpendicular to the second exterior mounting plate; and (3) a second interior pivot tab perpendicular to the second fastening plate; and a central body between the first end and second end, wherein the central body, the first fastening plate, and the second fastening plate are arranged in a single plane, and further wherein the first exterior mounting plate, the first interior pivot tab, the second exterior mounting plate, and the second interior pivot tab are arranged in parallel planes, wherein each of the parallel planes are perpendicular to the single plane, wherein the sofa stretcher rail is pivotable between a first position parallel to the seat box frame and a second position perpendicular to the seat box frame based at least in part on 1) a distance from a top edge of the first fastening plate to an attachment point of the first interior pivot tab and 2) a distance from a top edge of the second fastening plate to an attachment point of the second interior pivot tab.

4. The sofa stretcher rail of claim 3, wherein at least a portion of one or more of the central body, the first fastening plate, the second fastening plate, the first exterior mounting plate, and the second exterior mounting plate comprises a stiffening rib.

5. The sofa stretcher rail of claim 3, wherein the central body is curved.

6. The sofa stretcher rail of claim 3, wherein the first fastening plate and the second fastening plate are configured to couple the sofa stretcher rail to a rear back post of a sofa frame.

7. The sofa stretcher rail of claim 3, wherein the first exterior mounting plate and the second exterior mounting plate are configured to couple the sofa stretcher rail to a front sofa rail of a sofa frame.

8. The sofa stretcher rail of claim 3, wherein the first interior pivot tab and the second interior pivot tab are configured to couple to a seat box frame, said seat box frame comprising a front rail and a rear rail.

9. The sofa stretcher rail of claim 8, wherein upon coupling the first interior pivot tab and the second interior pivot tab to the seat box frame, at least a portion of the sofa stretcher rail is pivotable between a first position parallel to the seat box frame and a second position perpendicular to the seat box frame.

10. A sofa stretcher rail comprising:

a first end comprising:

1) a first exterior mounting plate configured to couple to a front sofa rail of a sofa frame when the first end is in a sofa stretcher rail first orientation;

2) a first fastening plate configured to couple to a rear back post of the sofa frame when the first end is in a sofa stretcher rail second orientation; and 3) a first interior pivot tab configured to couple to a seat box frame;

a second end comprising:

1) a second exterior mounting plate configured to couple to the front sofa rail of the sofa frame when the second end is in the sofa stretcher rail second orientation;

2) a second fastening plate configured to couple to the rear back post of the sofa frame when the second end is in the sofa stretcher rail first orientation; and 3) a second interior pivot tab configured to couple to the seat box frame; and a curved body between the first end and the second end, wherein when the first interior pivot tab and the second interior pivot tab are coupled to the seat box frame, at least a portion of the sofa stretcher rail is pivotable between a first pivot position parallel to the seat box frame and a second pivot position perpendicular to the seat box frame.

11. The sofa stretcher rail of claim 10, wherein the first end is a mirror image of the second end.

12. The sofa stretcher rail of claim 10, wherein when the first exterior mounting plate is configured to couple to the front sofa rail of the sofa frame the second fastening plate is configured to couple to the rear back post of the sofa frame, and the sofa stretcher rail is in the sofa stretcher rail first orientation, the sofa stretcher rail is pivotable in a first direction relative to the seat box frame; and wherein when the second exterior mounting plate is configured to couple to the front sofa rail of the sofa frame the first fastening plate is configured to couple to the rear back post of the sofa frame, and the sofa stretcher rail is in the sofa stretcher rail second orientation, the sofa stretcher rail is pivotable in a second direction relative to the seat box frame, said second direction opposite said first direction.

* * * * *